US005250128A

United States Patent [19]

Landua et al.

[11] Patent Number: 5,250,128

[45] Date of Patent: Oct. 5, 1993

[54] METHOD AND APPARATUS FOR HANDLING CORE PARTS FOR PROVIDING A READY-TO-CAST CORE STACK

[75] Inventors: Werner Landua, Mannheim; Reiner Rommel, Brühl; Jürgen Müller; Wolfgang Schimpf, both of Mannheim, all of Fed. Rep. of Germany

[73] Assignee: Adolf Hottinger Maschinenbau GmbH, Fed. Rep. of Germany

[21] Appl. No.: 770,344

[22] Filed: Oct. 3, 1991

[30] Foreign Application Priority Data

Jan. 15, 1991 [DE] Fed. Rep. of Germany ..... 4100917

[51] Int. Cl.[5] ..... B32B 31/04

[52] U.S. Cl. ..... 156/60; 156/152; 156/290; 156/291

[58] Field of Search ..... 156/60, 152, 290, 291, 156/308.2, 308.6, 390, 538, 556, 558, 559, 563, 578; 29/460

[56] References Cited

U.S. PATENT DOCUMENTS

| | | | |
|---|---|---|---|
| 3,274,679 | 9/1966 | Kennedy | 29/460 |
| 4,744,853 | 5/1988 | Landua et al. | 156/578 |
| 4,963,216 | 10/1990 | Watkins | 156/578 |

*Primary Examiner*—Caleb Weston

*Attorney, Agent, or Firm*—Antonelli, Terry Stout & Kraus

[57] ABSTRACT

A method and apparatus for improving kinematic characteristics and for obtaining greater variability with respect to the use possibilities when handling core parts for providing a read-to-cast core stack, wherein, following a removal from a core shooting machine, the core parts are assembled at a stacker to form a core stack, introduced into a dipping bath and subsequently supplied in a correct position to a casting machine. The stacker, successively stacks in each case an upper core or an already assembled core part stack, with the upper core part or the already assembled core part stack being exclusively linearly raised and, in each case, a lower core part is held in a floating manner by an air cushion, whereas the raised core part or core part stack is lowered onto the lower core part for assembly.

6 Claims, 5 Drawing Sheets

METHOD AND APPARATUS FOR HANDLING CORE PARTS FOR PROVIDING A READY-TO-CAST CORE STACK

FIELD OF THE INVENTION

The invention relates to a method for handling core parts for providing a core pack or stack, in which after being removed from a core shooting machine, the core parts are stacked together in a stacker to form a core stack, introduced into a dipping bath and then supplied in particular in positionally correct manner to a casting machine, as well as to an apparatus for handling core parts for providing a ready-to-cast core pack or stack, with a reception means for receiving the cores from a core shooting machine, an adhesion device, a stacker for joining together the core stack and a dipping means.

BACKGROUND OF THE INVENTION

Cores and moulds for producing castings are formed from individual core parts, which are assembled to form an overall core. For this purpose the individual core parts are individually produced in a core shooting machine and are subsequently assembled by adhesion to form the core stack. Adhesive application and joining together were initially carried out manually.

An automatic apparatus in the form of a core stacking machine for the assembly of ready-to-cast core stacks is proposed in DE-OS 35 26 295 including a removal means for discharging the cores from the core shooting machine, a pivoting means for the joint pivoting up of the still separate cores, an adhesive application system, a stacking means for joining together the core stack and a dipping means. For the joint swinging or pivoting of the cores, the pivoting means has a parallel guide, so that the initially horizontally juxtaposed cores, on pivoting in the vertical direction, are super-imposed with their regions to be interconnected. For this purpose the pivoting means has lateral clamping means for the cores, which act on corresponding reception means, which must be constructed on the cores during the manufacture of the cores, for example, hexagonal shoulders. The cores are then kept spaced in the vertical direction. The adhesion means has spray nozzles which can be pivoted between the cores and which can simultaneously be pivoted between the core parts and simultaneously position all the adhesion points. Thus, corresponding adhesion nozzles must be provided for the core part and must be located at a predetermined distance and with a predetermined arrangement on the core part for positioning the adhesion points and which can at the best be adapted by complicated reequipping measures on different types of core parts. After positioning the adhesion points the lifting device engages below the bottom core part and initially raises the same and then, by the bottom core part the other core parts and simultaneously the clamping means release the core parts. The thus formed core stack is pressed together under a certain pressure and subsequently moved to a dipping unit with a dipping tank, where the core stack is placed on a dipping table and immersed with the latter into the dipping liquid.

While an apparatus of the aforementioned type operates in a satisfactory manner the proposed apparatus can only process predetermined core parts for predetermined core stacks, unless extensive reequipping and modification measures are taken. In addition, there is a considerable moment of inertia through the pivoting of the spaced core parts, so that high rotary forces must be expended. Finally, the individual core parts are fixed to a relatively marked extent by the clamping means and the reciprocal relative positioning given by the clamping means is maintained even after placing on the lifting means. Thus, as a result of the necessary tolerance during the manufacture of the core parts, the core parts may not be readily assembled and may instead by subject to damage at the fitting points.

SUMMARY OF THE INVENTION

The aim underlying the present invention resides in providing a method and an apparatus for handling core parts for providing a ready-to-cast core stack which, while avoiding the aforementioned disadvantages encountered in the prior art and providing kinematic improvements, particularly ensuring a secure, reliable assembly of the individual core parts without any damage to the core parts.

According to invention, in the case of a method of the aforementioned type, the stacker is exclusively linearly raised in successive manner in each case an upper core part or an already assembled core part stack and that a lower core part is kept floating by an air cushion, while the raised core part or core part stack is placed on the lower core part for assembly. An inventive apparatus solves the problem in that the reception means for the core parts has a pallet for receiving the core parts and that the receptacles have air outlets connected to a compressed air source for producing the air cushion carrying the core parts.

As a result of the exclusively linear movement of the initially not yet interconnected individual core parts, the high torques necessary in the prior art are no longer required. This is made possible by the fact that a pallet displaceable on a linear conveyor with individual receptacles for the individual core parts can be used and which merely have to be replaced for adapting to different core parts for the production of core stacks for different objects to be cast, such as different engines. Apart from this possibility of horizontal displaceability, a contribution is particularly made by the air cushion to a problem and complication-free assembly of the individual core parts to form the core stack. The lower core floats on the air cushion and is movable on all sides, so that if a core or already formed core part stack is placed upon from above, the lower core part can adapt with its assembly contours. The variability of the use possibilities is also increased by providing an adhesive spray nozzle movable and pivotable in different directions and which successively controls the individual adhesion points. There are no nozzles provided with rigid relative spacings from the outset and which are only adapted to specific core parts and which require reequipping for dealing with other such parts.

According to preferred developments, prior to the dipping into a dipping tank of the core stacks in the stacker, the core stack are initially rotated by at least 90° about a first horizontal rotational axis into a transfer position for a core manipulator and then by 180° about a horizontal axis at right angles to the first horizontal rotational axis over the dipping tank. Prior to the pivoting about the first horizontal rotation axis by 90°, the core stack is rotated about a vertical axis. In addition, in the transfer position, the core stack is rotated about a further axis opposite to the rotation by 90° about the vertical axis. Or prior to the transfer to the carry-away gripper the core stack is rotated by 90° about a vertical axis. Through this movement sequence, as a result of the different movements and movement possibilities, a high adaptability to different types of core parts and core stacks to be produced therefrom is achieved, quite independently from where action has to take place on the corresponding core parts or stacks, in which position they must be dipped in the dipping tank or the dipping bath therein, so that the degassing openings for the core stack are not also dipped into the liquid and also quite independently of where and in which position action takes place on the assembled core stack for conveying away in order to supply it to the casting means.

In a preferred development, the inventive apparatus is characterized by vertically movable grippers pivotable about a vertical axis for receiving individual core parts or partly assembled core stacks and/or placing initially raised core parts or partly assembled core stacks on a core part still in its receptacle on the slide and carried by the air cushion.

The inventive apparatus is preferably constructed in such a way that the adhesion means has a triaxially movable adhesion head with a pivotable adhesive spray nozzle, so that all the given adhesion points on a core part can be controlled and that the stacker is followed by a core manipulator, which is movable horizontally along a rail to the stacker and is movable by the upper of two gripper arms acting vertically on the core stack between the said arms to the stacker and which is pivotable about a horizontal axis for conveying the core stack to the dipping unit.

The invention leads to the assembly of core stacks which are centrifuged after dipping and need only be dried in a further stage for obtaining casting resistance.

A fundamental idea of the invention is to provide an apparatus for the assembly of the most varied mould or core stacks for different parts to be cast, such as different engine blocks, particularly if the individual mould or core stacks or individual mould and core parts have to be arranged and aligned differently during assembly and machining.

BRIEF DESCRIPTION OF THE DRAWINGS

Further advantages and features of the invention can be gathered from the claims and description of embodiments with reference to the attached drawings, wherein:

DETAILED DESCRIPTION

Figure 1:
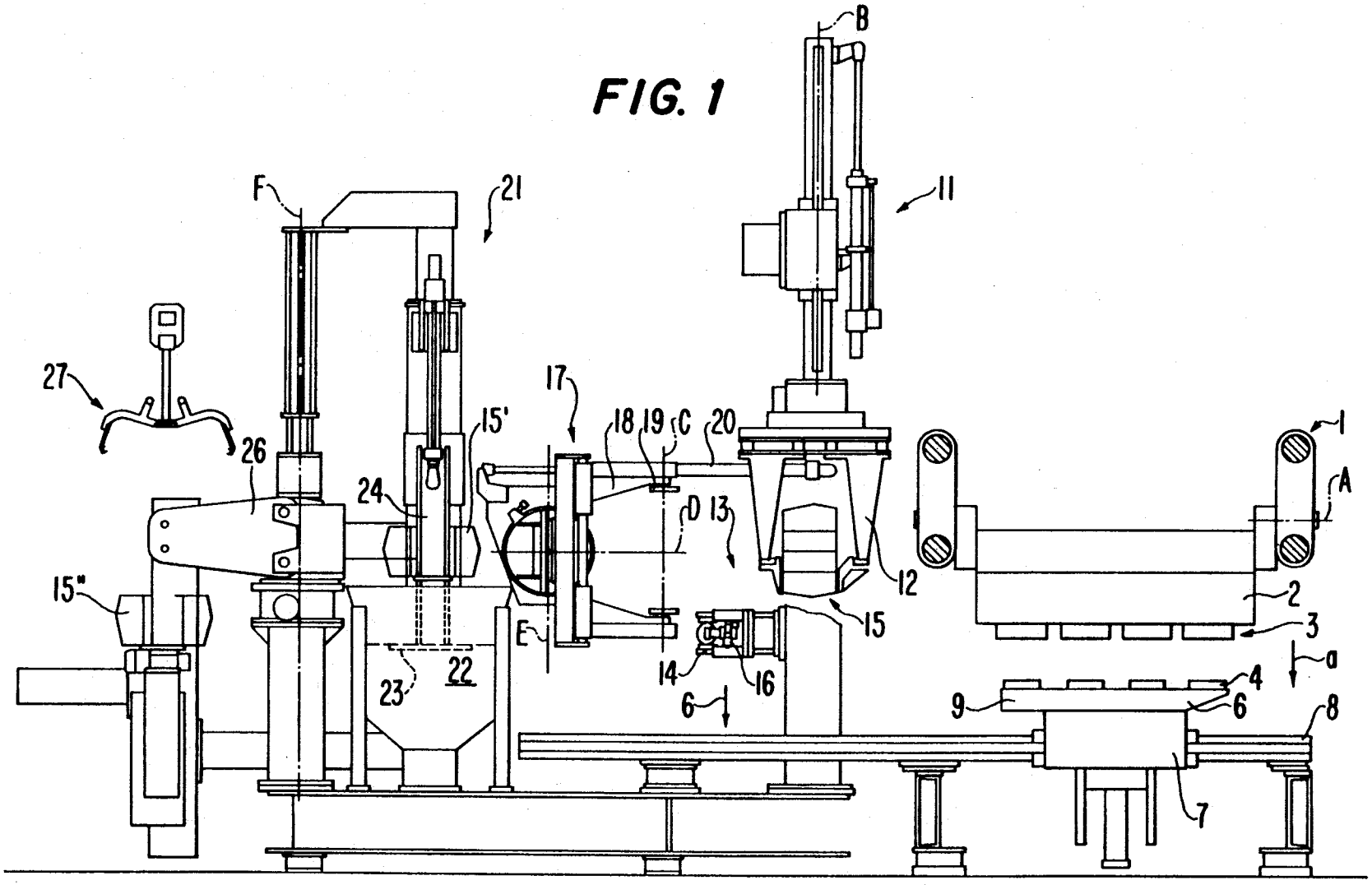
FIG. 1 is a schematic view of a preferred development of the inventive apparatus for handling core parts for providing a ready-to-cast core stack.

The inventive apparatus is provided for taking over core parts produced in a core shooting machine 1 and which are to be processed to form a ready-to-cast core stack. As shown in FIG. 1 a tool 2 of the core shooting machine 1 holds the core parts 3 after manufacturing of the core parts 3, with the core parts 3 being brought by the tool 2 into the position shown in FIG. 1. For this purpose, the tool 2 of the core shooting machine 1 is optionally rotated about a horizontal axis A. In the position shown in FIG. 1 the core parts 3 are held by the tool 2 above receptacles 4 of a pallet 6 of the apparatus. The pallet 6 is positioned on a slide 7, which is linearly displaceable on a conveyor 8. The receptacles 4 for the core parts 3 have air ducts and outlets 9. The air ducts and outlets 9 can be connected with an air pressure source for the purpose to be explained more fully hereinbelow.

A stacker 11 is provided above the conveyor 8, with the stacker 11, including grippers 12 adapted to carry out a substantially horizontal gripping movement and adapted to be pivotable about a vertical axis B. The stacker 11 also has an adhesion means 13 with an adhesion head 14, which is provided with an adhesive spray nozzle 6. The adhesion head 14 can be vertically lowered along the arrow b and can be moved horizontally both in the plate plane and at right angles thereto. The spray nozzle 16 can also be pivoted to all sides, so as to be able reach any point of a core part moved under it and is provided with adhesive at any desired angle and in any direction.

A core manipulator 17 is connected to the stacker 11, with the core manipulator 17 including two linearly movable grippers 18, provided with gripping disks 19, pivotable about the axis C. The grippers 18 can be pivoted about a horizontal axis D, arranged symmetrically between the grippers 18 in the illustrated position and about a vertical axis of rotation E.

A dipping means 21 is connected to the core manipulator 17 with the dipping means 21 having a dipping tank 22 and a dipping table 23, located on a vertically displaceable arm 24 and adapted to be lowered into the dipping tank 22. The apparatus also has a centrifugal manipulator 26 and a carry-away gripper 27 connected thereto.

The core parts 3, individually designated K1, K2, K3 and K4 (FIG. 4), are placed on their corresponding receptacles 4 on the pallet 6 by the lowering of the tool 2 in the direction of the arrow A. For this purpose, the receptacles 4 or the pallet 6 can have holders acting on the core parts 3, when the core parts 3 are merely frictionally held in the tool 2, so as to be able to hold the core parts 3 on the receptacles 4 when the tool 2 is raised again thereby enabling the core parts 3 to be separated from the tool 2. The tool 2 could also be provided with ejectors to eject the core parts 3.

Subsequently the slide 7 moves along the conveyor 8 up to the core part K1 below the stacker 11, while the following core part K2 simultaneously passes below the adhesion means 13. The core part K1 is raised by the grippers 12 from the stacker 11. Simultaneously, the spray nozzle 16 provides adhesive to the surface of the core part K2 located below it, namely at the intended points. The slide 7 then moves far enough back to ensure that the core part K2 is positioned below the gripper 12 and then the gripper, with the core part K1, is lowered. Simultaneously, the core part K2 is slightly raised by compressed air supplied through the air ducts and outlets and is maintained in a raised position on a thus formed air cushion, and, optionally, beforehand, the grippers engaging on the core parts 3 are loosened for the removal of the latter/core parts 3. The grippers 12 and the core part K1, held by the grippers 12 are then lowered to such an extent that the core part K1 with its contours formed on the lower surface and adapted to that of the core part K2 engages in accurately fitting manner in core part K2. Through the location of the core part K2 on the air cushion, the core part K2 can be oriented in accordance with the lowered core part K1, without interference by the holding means. This avoids any damage due to interengaging contours of the two core parts as a result of any slight displacement.

The grippers 12 are then detached from the core part K1 and are further lowered until reaching a level of the core part K2. The grippers 12 are laterally applied to the core part K2 and raise the core part stack of core parts K1 and K2. The other parts, here K3 and K4, are then provided in the described manner with adhesive and connected to the core part pack to form the final overall core stack 15. In a manner described in DE-OS 35 26 265, when the grippers act on the bottom core part K4, a pressure cylinder with a control device can act on the top of the core stack 15, in order to further compress the core parts 3, in addition to their own weight, so as to ensure a good adhesion action.

After producing the overall core stack 15 in the described manner, the core stack 15 is pivoted by the stacker 11 about the vertical axis B by 90°, so that subsequently the upper gripper 18 of the core manipulator 17 passes between the grippers 12 of the stacker 11 and can act together with its lower counterpart on the core stack 15 from both above and below. Following the gripping action of gripper 18, the stack is released by the grippers 12. The core manipulator 17 moves back along a rail 20 out of the area of the stacker 11, pivots the gripper 18 about the axis D and then about the axis E, so that the core stack 15 is held by the gripper 18 in position 15'. Optionally, the disks 19 can be pivoted, if for example, the core stack 15' is to be dipped in the dipping bath pivoted by 180°. The alignment is dependent upon the position of the air ducts and outlets 9 on the core stack 15 or 15' and through which the air in the core stack 15 escapes on casting. These air ducts and outlets 9 must not be dipped into the dipping bath.

The core stack 15' is above the dipping tank 22 in a position where it is laterally held by the grippers 18, so that the dipping table 23 is moved against the downwardly directed side and can receive the core stack 15. The grippers 18 release the core stack 15' and pivot the core stack 15' back into the position shown in FIG. 1. By a lifting mechanism the dipping table 18 is immersed so far in the dipping tank 22 and the dipping bath therein such that the core stack 15 is largely immersed in the dipping tank 22, but the air ducts and gas outlets 9 are not immersed, so that no dipping bath liquid can pass through the same into the core stack 15. After adequate immersion, the dipping table 23 is raised until the core stack 15' has again passed out of the dipping tank 22 into its position above the same in FIG. 1. The core stack 15 is here gripped by the centrifugal manipulator 26, which propels around the core stack 15 within a paste protected by trickling or dripping walls or the like, so that the dipping liquid is centrifuged off and drops back into the dipping tank 22. The level of the dipping tank 22 is kept constant by overflows and a pumping mechanism. After centrifuging, the centrifugal manipulator 26 conveys the core stack 15 into position 15'', with the core stack 15' being optionally aligned in a desired manner, that is, the core stack 15' is rotated by, for example, 90° into the illustrated position, so that the carry-away grippers 27 laterally engage on the core stack 15' and can then convey the core stack 15' away for intermediate storage or directly for casting.

Figure 2:
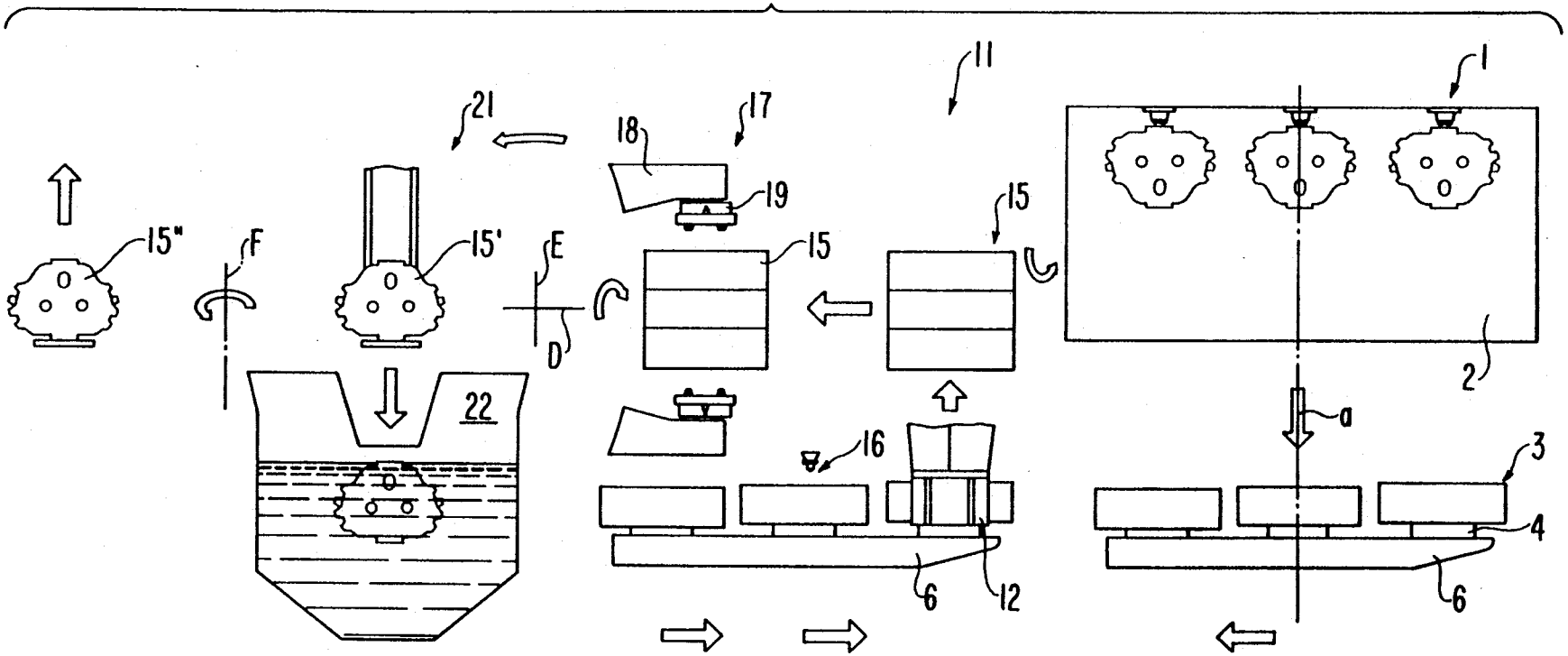
FIG. 2 a first embodiment of a method for cores for a six-cylinder engine.

The process sequence is shown in detail in FIGS. 2 to 5 for core parts for producing different engines. FIG. 2 only shows three core parts 3, designated K1 to K3. Prior to placing on the receptacle 4 of the pallet 6, the core parts K1–K3 are pivoted about a horizontal axis by 90° by the tool 2. After placing the core parts K1–K3 on the receptacles 4, the core parts K1–K3 are moved to the left by the pallet 6 and, in this position, the core part K1 is in the vicinity of the stacker 11 (FIG. 1) and the core part K2 below the spray nozzle 16. The core part K1 is then gripped by the grippers 12 of the stacker 11. Unlike in FIG. 1, in the present embodiment, in the viewing direction, one of the grippers 12 is upstream of the core part K1 and a further gripper, downstream thereof. The core stack 15 is then formed in the above-described manner, is taken over by core manipulator 17 and, due to the position of the gripper 12 of the stacker 11, is not previously restricted by the vertical axis B, because the grippers 12 are in a position in which the upper of the grippers 18 can act between them and on the core stack 15. FIG. 2 shows the pivoting of the core stack 15 by the core manipulator 17 about the axis D and the raising of the core stack 15 into the position 15' above the dipping tank 22 by pivoting about the axis E. Dipping takes place in the above-described manner. After removal from the dipping tank 22 the core stack 15 is again pivoted by 180° about the axis F so that it can be conveyed away.

Figure 3:
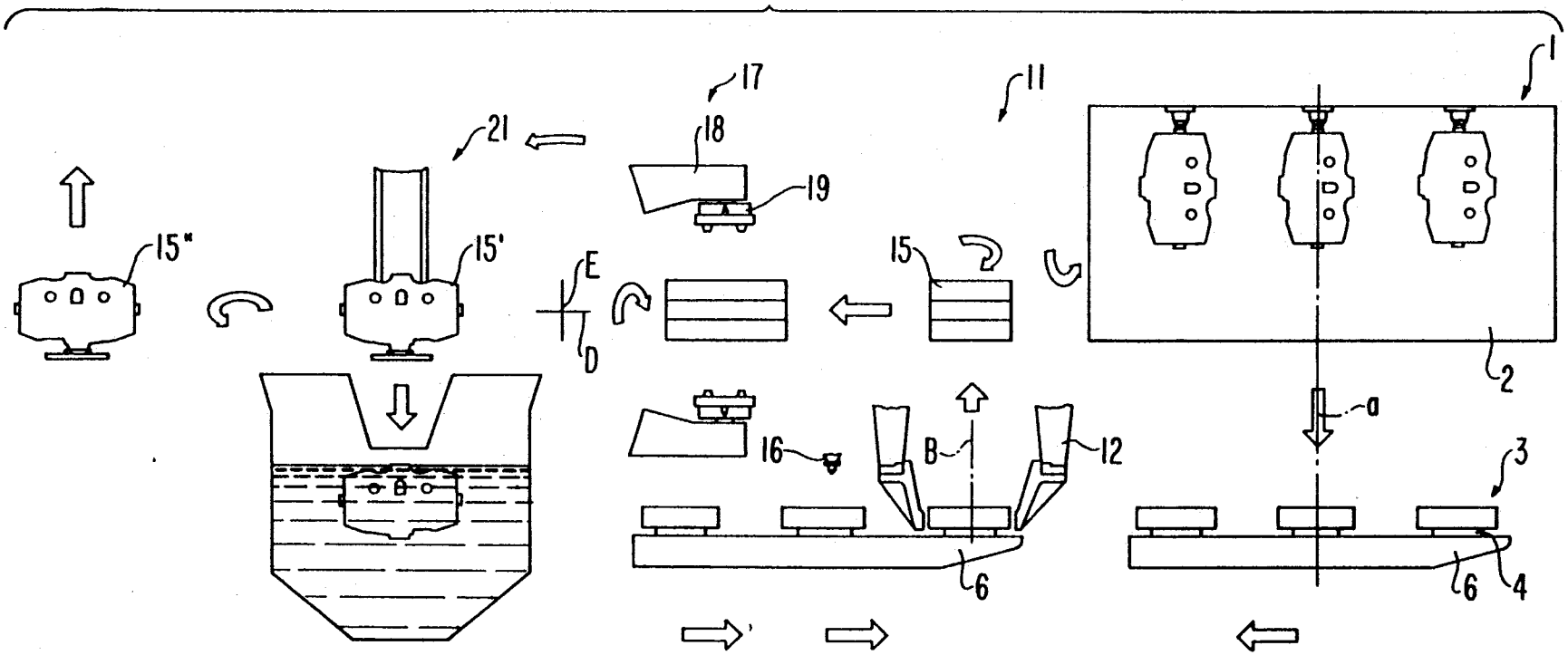
FIG. 3 a second inventive embodiment of the present invention.

In FIG. 3 the sequence is the same as that in FIG. 1 and, in addition to the sequence of FIG. 2 merely has a pivoting of the grippers 12; therefore, the core stack 15 is pivoted about the axis B so that the upper end of the grippers 18 can engage between the grippers 12 for taking over the core stack 15. This is due to the fact that the grippers 12, in FIG. 2, act on the core part K1, etc. in the plate plane and not at right angles, as in FIG. 2.

Figure 4:
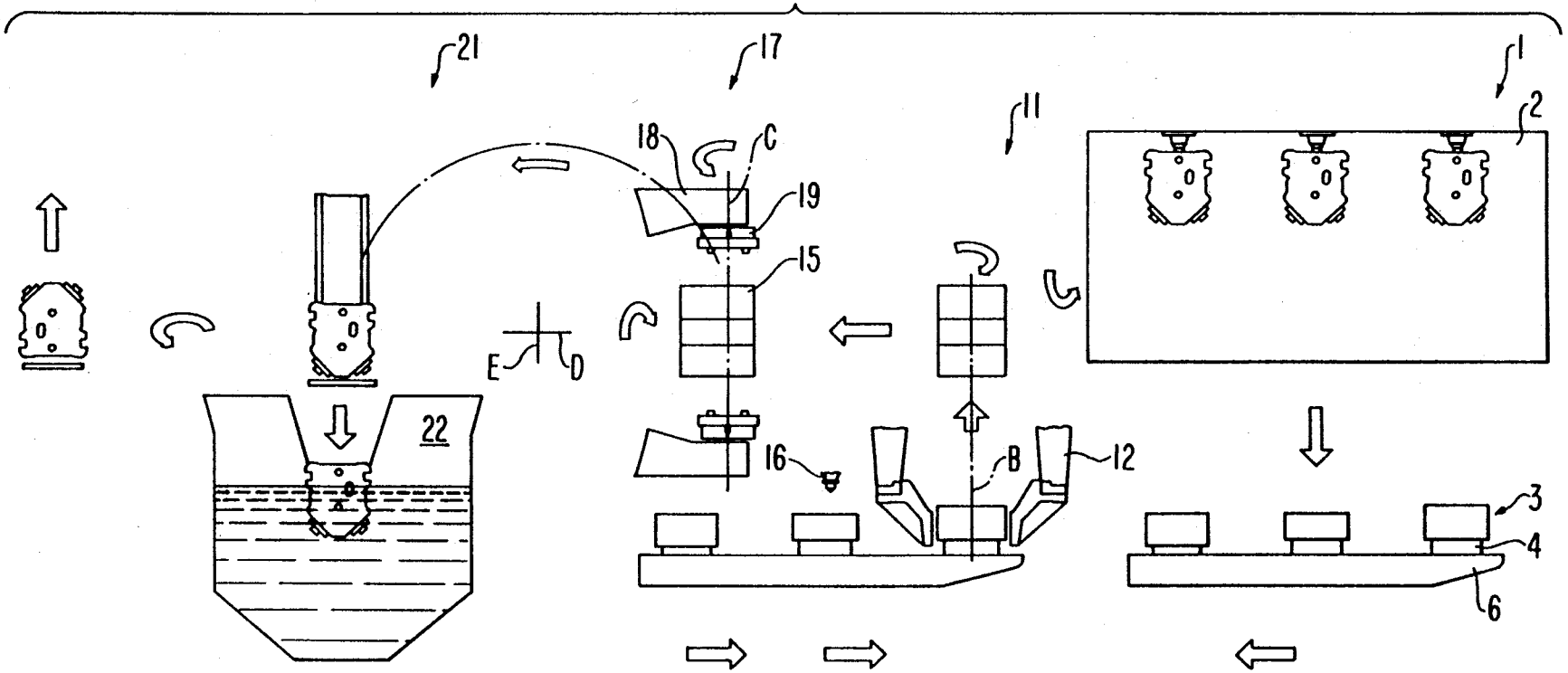
FIG. 4 is a further inventive embodiment of the method of the present invention.

The process sequence of FIG. 4 fundamentally corresponds to that of FIG. 3. Additionally the core stack 15 is pivoted about the vertical axis D by 90° by the disks 19 on the grippers 18 of the core manipulator 17, to ensure that on dipping into the dipping tank 22, the core stack 2 gas outlets 15 air and are directed 9 in and upward direction and are not immersed in the dipping tank 22. This is due to the fact that the individual core parts are here produced in a different position in the core shooting machine than in the case of the core parts for the process sequence of FIG. 3.

Figure 5:
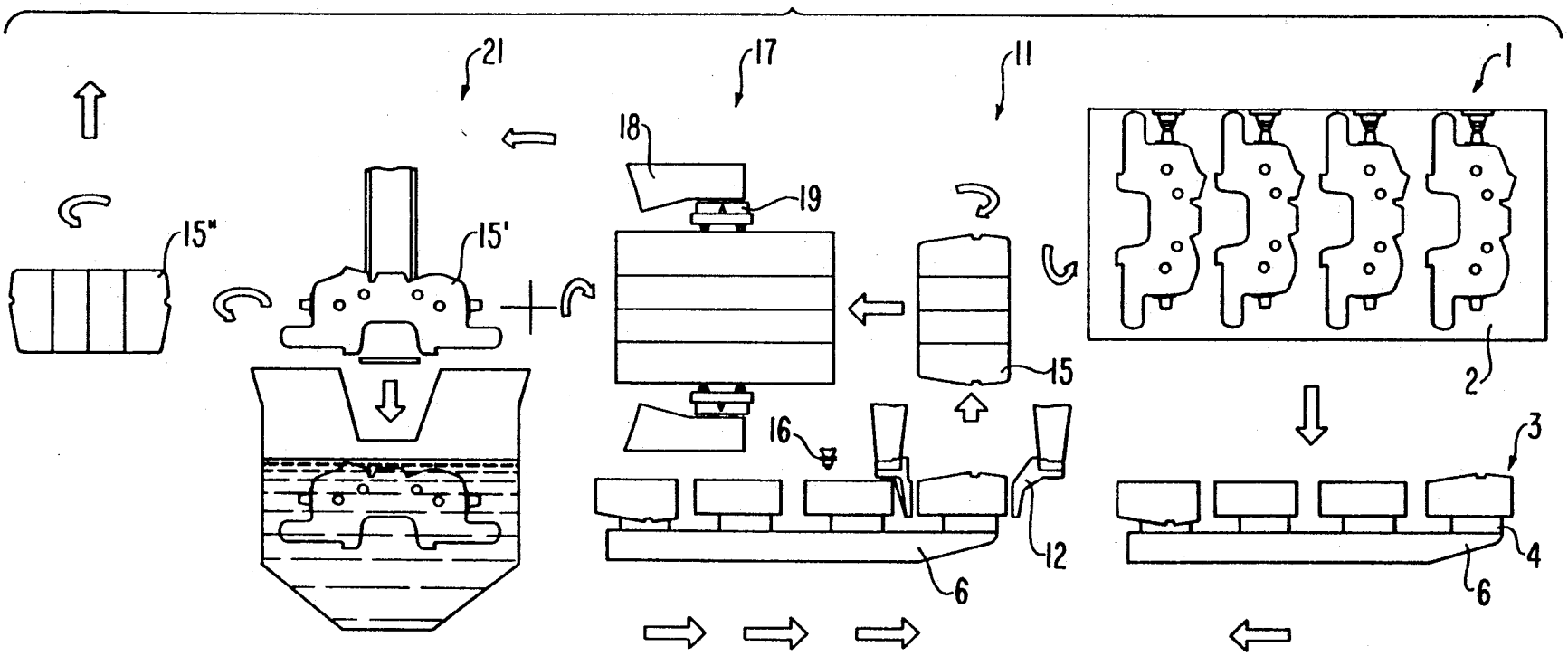
FIG. 5 an embodiment of the method according to the present invention for core parts for a four-cylinder engine.

In the process sequence of FIG. 5 for the core parts of a four cylinder engine, the above-described method step is not put into effect. In addition to the method steps described relative to FIG. 3, prior to transfer to the carry-away grippers 27, the core stack 15 is pivoted again by 90° about a vertical axis by the core manipulator 17, so that the grippers 27 can act in the correct way and convey away the core stack 15''. Otherwise the process sequence is as in FIG. 3.

We claim:

1. Method for handling core parts for providing a core stack, the method comprising the steps of removing the core parts from a core shooting machine, sticking the core parts together in a stacker after removal from the core shooting machine to form a core stack, immersing the core stack into a dipping tank, and supplying the core stack in a positionally correct manner to a casting machine, wherein the step of sticking the core parts together in the stacker includes successively exclusively linearly raising in each case one of an upper core part or an already assembled core part and holding, in each case, a lower core part in a floating manner by an air cushion while the raised core part or core part stack is lowered onto the lower core part for joining.

2. Method according to claim 1, wherein, prior to joining, adhesion points of one core part are successively positioned by a spray nozzle of an adhesion means.

3. Method according to one of claims 1 or 2, wherein the core stacks stacked in the stacker, prior to an immersing in the dipping tank, are initially at least rotated by 90° about a first horizontal rotational axis into a transfer position for a core manipulator and subsequently by 180° about a horizontal axis, at right angles to the first horizontal rotational axis, over the dipping tank.

4. Method according to claim 3, wherein, prior to pivoting about the first horizontal rotational axis, the core stack is rotated by 90° about a vertical axis.

5. Method according to claim 4, wherein the core stack in a transfer means is rotated by 90° about a further axis in an opposite direction to a direction of rotation about the vertical axis.

6. Method according to claim 3, wherein prior to a transfer to a carry-away gripper, the core stack is rotated by 90° about a vertical axis.

* * * * *